US006206366B1

(12) United States Patent
Schmid

(10) Patent No.: US 6,206,366 B1
(45) Date of Patent: Mar. 27, 2001

(54) ANTIDROP PROTECTOR FOR SHEET-STACKING APPARATUS

(75) Inventor: Frank Schmid, Krefeld (DE)

(73) Assignee: Jagenberg Papiertechnik GmbH, Neuss (DE)

( * ) Notice: Subject to any disclaimer, the term of this patent is extended or adjusted under 35 U.S.C. 154(b) by 0 days.

(21) Appl. No.: 09/256,925

(22) Filed: Feb. 24, 1999

(30) Foreign Application Priority Data

Feb. 25, 1998 (DE) ..... 198 07 853

(51) Int. Cl.[7] ..... B65H 31/10; B65H 31/04; B66B 5/12

(52) U.S. Cl. ..... 271/217; 271/213; 271/214; 187/363; 187/359; 187/361

(58) Field of Search ..... 271/213, 214, 271/215, 217, 219; 414/926; 187/366, 370, 363, 362, 361, 359, 364, 367

(56) References Cited

U.S. PATENT DOCUMENTS

| | | | | |
|---|---|---|---|---|
| 710,038 | * | 9/1902 | Burgart | 187/363 |
| 855,646 | * | 6/1907 | Lehn | 187/367 |
| 1,278,742 | * | 9/1918 | Pichler | 187/363 |
| 1,714,297 | * | 5/1929 | Crispen | 187/363 |
| 2,266,915 | * | 12/1941 | Steedman | 187/363 |
| 3,848,706 | * | 11/1974 | Darwent | 187/374 |
| 4,254,939 | * | 3/1981 | Buzzard et al. | 187/367 |
| 4,725,185 | * | 2/1988 | Neagu | 414/540 |
| 4,745,726 | * | 5/1988 | Rosenthal | 187/83 |
| 5,628,505 | | 5/1997 | Voss . | |

FOREIGN PATENT DOCUMENTS

| | | | | |
|---|---|---|---|---|
| 183212 | * | 3/1907 | (DE) | 187/363 |
| 2512685 | * | 9/1975 | (DE) | 187/359 |
| 27 49 912 | | 11/1979 | (DE) . | |
| 411160 | * | 6/1910 | (FR) | 187/363 |
| 23312 | * | 10/1911 | (GB) | 187/363 |
| 1429181 | * | 3/1976 | (GB) | 187/367 |
| 1668268 | * | 8/1991 | (SU) | 187/367 |

* cited by examiner

*Primary Examiner*—Donald P. Walsh
*Assistant Examiner*—Daniel K Schlak
(74) *Attorney, Agent, or Firm*—Herbert Dubno; Andrew Wilford

(57) ABSTRACT

An apparatus for stacking sheets has a frame defining a stacking station, a conveyor for delivering the sheets continuously one after the other at a predetermined upper level in a transport direction to the station, and a platform vertically displaceable in the stacking station between the upper level and the lower level. The antidrop protector includes a vertically extending rack fixed on the frame, a lever pivoted on the platform adjacent the rack and having a pair of arms one of which is connected to a lift cable, a stop on the other of the lever arms engageable in the rack, and a spring braced between the platform and the lever. The cable is connected to a drive that tensions the cable, displaces the platform vertically, and rotates the lever in one rotational sense. The spring urges the lever in the opposite sense so that when the cable is detensioned the spring urges the stop into the rack and vertically arrests the platform.

6 Claims, 2 Drawing Sheets

ANTIDROP PROTECTOR FOR SHEET-STACKING APPARATUS

FIELD OF THE INVENTION

The present invention relates to a sheet-stacking apparatus. More particularly this invention concerns such an apparatus which forms stacks of continuously arriving sheets.

BACKGROUND OF THE INVENTION

In a paper mill a continuous strip of paper moving longitudinally at high speed must be transversely cut into individual sheets that must then be piled in individual stacks on pallets or the like. The stacking must be done without interrupting the flow of continuously arriving sheets, so that when a stack is complete it is necessary to get it out of the way and bring a new pallet into place while somehow catching and holding the sheets that arrive during the changeover.

Commonly owned U.S. Pat. No. 5,628,595 describes an apparatus having a downstream end spaced upstream in a horizontal transport direction from a stacking station for delivering the sheets continuously one after the other at a predetermined upper level in the direction to the station and a main platform vertically displaceable in the stacking station between an upper position below the upper level and a lower position. An auxiliary platform below the upper level is formed by a plurality of parallel rods horizontally displaceable in the direction between an extended position in the station above the main platform and a retracted position upstream of the main platform. A plurality of vertically extending separator elements having bent-over upper ends projecting downstream between the rods in the transport direction are displaceable between a separating position projecting into the station between the auxiliary platform and the upper level and engaged between trailing edges of sheets and a withdrawn position out of the station between the station and the conveyor downstream end. Each element has a vertical length greater than the vertical distance between the auxiliary platform and the upper level.

German patent 2,749,912 issued Nov. 8, 1971 to R. Schmitz shows an arrangement where the sheets are deposited on a platform that is lowered in a frame as the stack formed on the platform grows. The platform is suspended from cables and can, when fully loaded, weigh several tons. It is sometimes moved vertically as much as 3 m. Obviously if, for instance, one of the cables broke and the loaded platform dropped, it could do considerable damage to the apparatus. Accordingly this German patent proposes an antidrop mechanism that arrests the platform by jamming toothed guide wheels into a stationary rack. Such a system is effective but fairly complex.

OBJECTS OF THE INVENTION

It is therefore an object of the present invention to provide an improved sheet-stacking apparatus.

Another object is the provision of such an improved sheet-stacking apparatus which overcomes the above-given disadvantages, that is which has an improved antidrop mechanism.

SUMMARY OF THE INVENTION

An apparatus for stacking sheets has according to the invention a frame defining a stacking station, a conveyor for delivering the sheets continuously one after the other at a predetermined upper level in a transport direction to the station, and a platform vertically displaceable in the stacking station between the upper level and a lower level. The anti-drop protector includes a vertically extending rack fixed on the frame, a lever pivoted on the platform adjacent the rack and having a pair of arms one of which is connected to a lift cable, a stop on the other of the lever arms engageable in the rack, and a spring braced between the platform and the lever. The cable is connected to a drive that tensions the cable, displaces the platform vertically, and rotates the lever in one rotational sense. The spring urges the lever in the opposite sense so that when the cable is detensioned the spring urges the stop into the rack and vertically arrests the platform.

Thus this simple system ensures that, as soon as the cable is detensioned, for instance when the cable breaks or something prevents the platform from dropping, the stop will engage in the rack and prevent further dropping of the platform. The action is simple and foolproof, and the equipment is simple and inexpensive. In addition, unlike the system of the abovecited German patent, there is no significant lateral stress on the rack in the blocking position, so it can withstand considerable forces.

According to the invention the spring is a compression spring braced against the one arm. The lever has a central pivot and the two arms extend at an obtuse angle to each other. Normally the one arm connected to the cable extends horizontally from the pivot and the other arm carrying the stop extends upward at an acute angle to the horizontal from the pivot.

The other arm is provided with an elastomeric bumper carrying the stop so that, when it moves into the movement-blocking position, it does not stop the platform too suddenly.

In addition in accordance with the invention a switch on the platform is operable by the lever on rotation in the opposite sense. This switch can shut down the equipment and/or cause a trouble alarm to be emitted.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
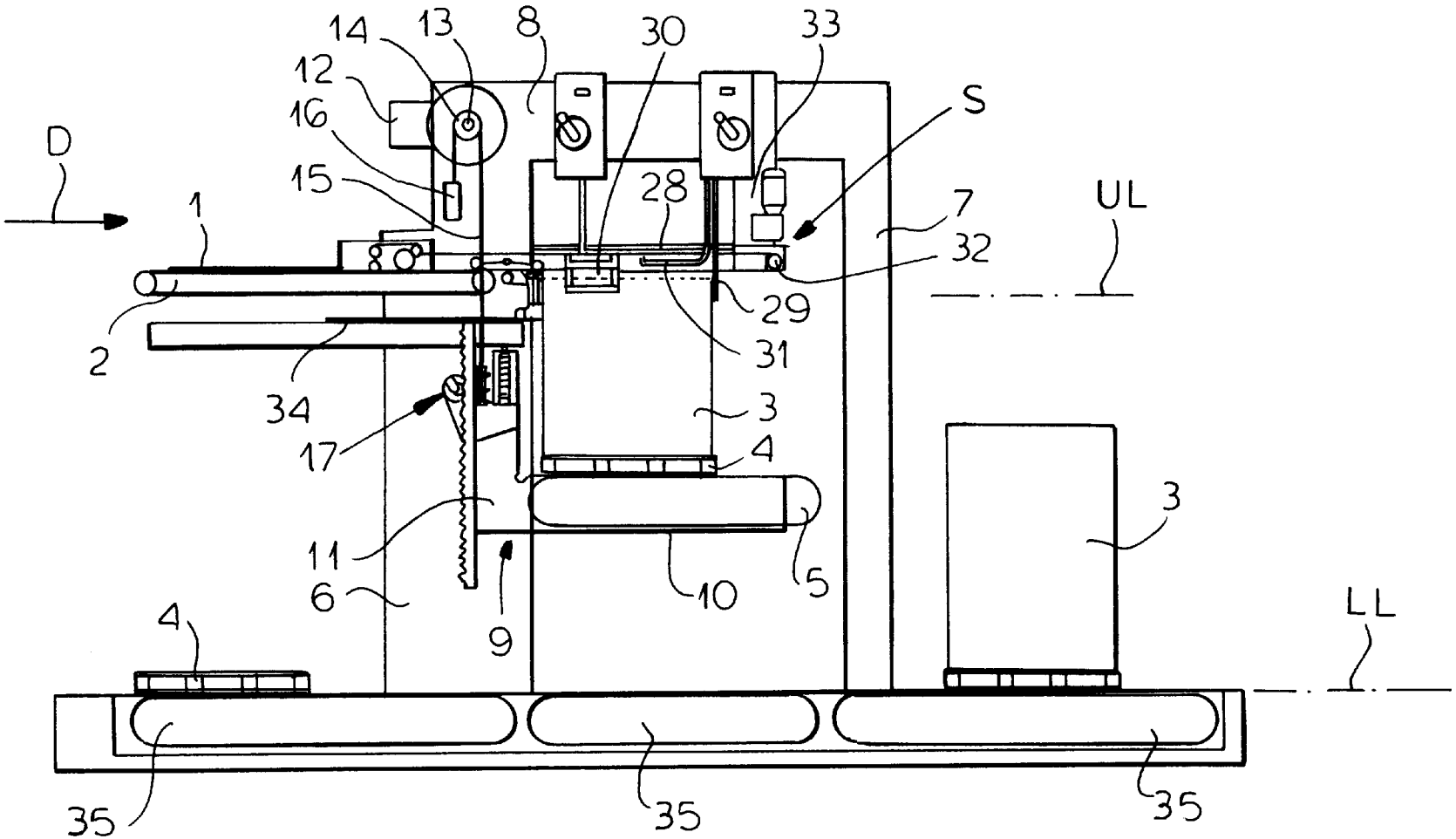
FIG. 1 is a small-scale and partly diagrammatic side view of the sheet-stacking apparatus according to the invention.

As seen in FIG. 1 a succession of sheets 1 are delivered in overlapping condition to a stacking station S in a transport direction D by a conveyor 2 from an unillustrated crosswise slitter. The sheets 1 are gripped by upper conveyor belts 28 and separated by air currents from nozzles 31 so that they butt against back boards 29 and are aligned between side shaker plates 30 to form a neat stack 3 atop a pallet 4 on a short platform conveyor 5. The conveyors 2 and other equipment are supported on a frame formed by upstream posts 6 flanking the conveyor 2, downstream posts 7, and horizontal beams 8 interconnecting upper ends of these posts 6 and 7. The back boards 29 and downstream rollers 32 of the upper conveyor belts 2 are mounted on carriages 33 that are movable on the frame 6, 7, 8 to accommodate different sheet sizes. An intermediate platform 34 can be slid into place to catch the sheets 1 while a full pallet 4 is exchanged for an empty one.

The pallet 4 and conveyor 5 can be moved between a lower position in a plane LL level with a floor conveyor 35 and an upper position in a plane UL level with the input conveyor 2. To this end the conveyor 5 is mounted on horizontal arms 10 of a pair of massive L-shaped steel plates 9 lying in respective vertical planes flanking the stacking station S and having upper arms 11 slidable in vertical guides illustrated schematically at 36 in FIG. 2 and fixed on the upstream posts 6. The plates 9 are some 40 mm thick and the arms 10 and 11 are some 400 mm wide so as to be very stiff and capable of supporting several tons.

The upper end of each arm 11 is fixed to an end of a cable or chain 15 that passes over a respective drive wheel 14 and which carries a counterweight 16 at its other end. A main drive motor 12 is connected through an unillustrated step-down transmission to a horizontal shaft 13 journaled in the upper ends of the posts 6 and carrying both of the wheels 14, so that the two plates 9 can be raised and lowered synchronously.

Figure 2:
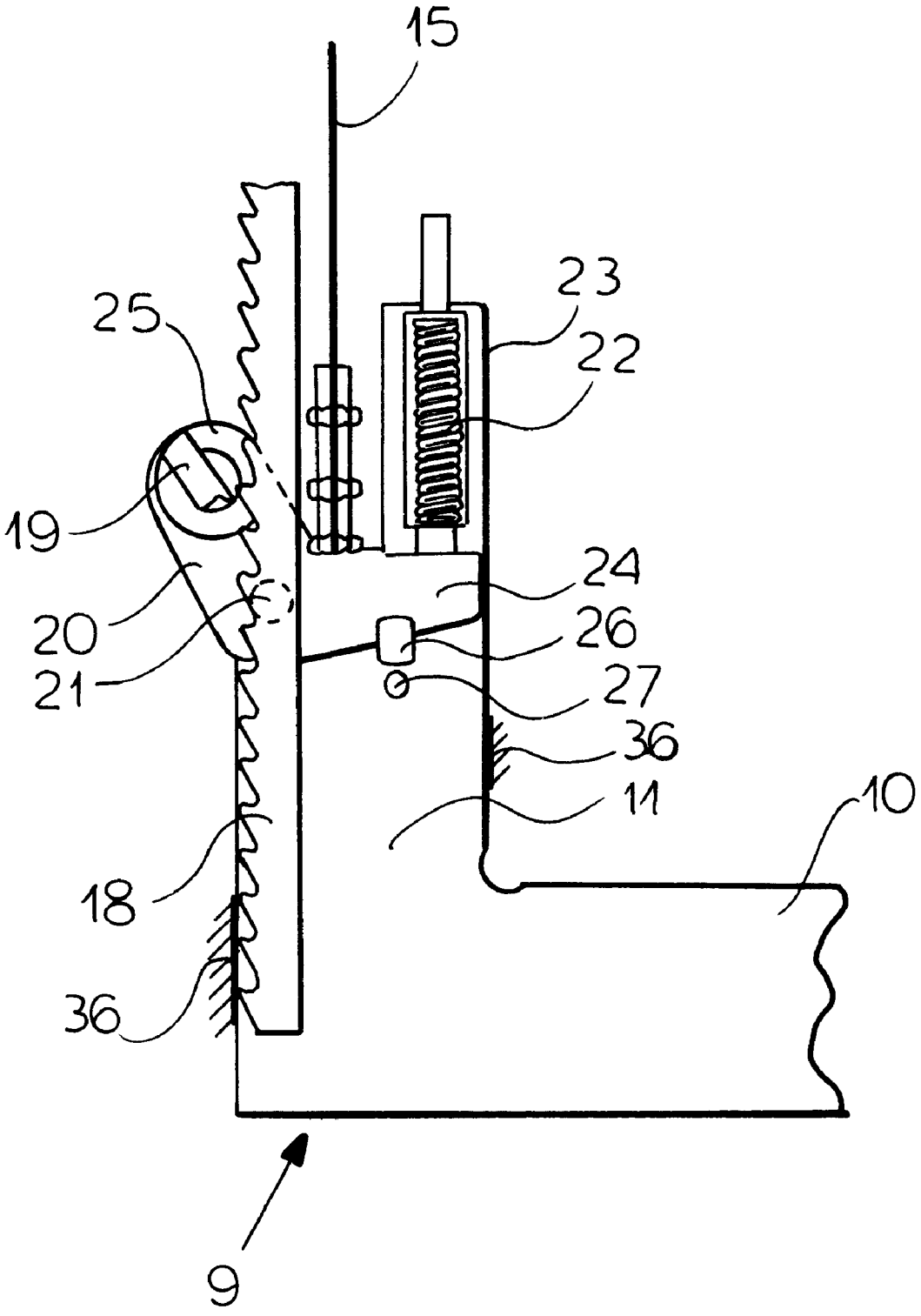
FIG. 2 is a large-scale view of a detail of FIG. 1.

In accordance with the invention as shown in FIG. 2 each plate arm 11 has a pivot 21 carrying a two-arm lever 17 having one arm 20 extending upward at an angle of about 45° to the horizontal and another arm 24 extending generally horizontally. The arm 20 carries via an elastomeric cushion 25 a tooth or dog 19 that can engage between upwardly directed teeth of a respective rack 18 fixed on the respective post 6. The arm 24 is connected to the end of the respective cable 15 and is urged downward, into a stopping position with the dog 19 engaged in the rack 18, by a spring 22 received in a housing 23 fixed on the arm 11. The arm 24 also carries an abutment 26 engageable with an arm 27 of an emergency switch connected to an unillustrated alarm and control system.

Under normal circumstances the cables 15 are each under considerable tension so that they pivot the levers 17 counterclockwise into the illustrated freeing position with the springs 22 compressed and the dogs 19 out of engagement with the respective racks 18. If, however, either of the cables 15 breaks, the respective lever 17 will immediately be pivoted clockwise by its spring 22 to engage its dog 19 in the rack 18 and prevent any dropping of the stack 3. At the same time that the dog 19 engages in the rack 18, the switch 27 will be actuated to arrest the motor 12 and sound an alarm. Any damage the considerable weight of the stack could do is therefore avoided.

I claim:

1. An apparatus for stacking sheets, the apparatus comprising:

a frame defining a stacking station;

conveyor means for delivering the sheets continuously one after the other at a predetermined upper level in a transport direction to the station;

a platform vertically displaceable in the stacking station between the upper level and a lower level;

a vertically extending rack fixed on the frame and having an outer side provided with an array of teeth and an opposite inner side;

a lever pivoted on the platform at a pivot adjacent the inner side of the rack and having an outer arm extending horizontally past the rack to the outer side thereof and an inner arm;

a cable or chain having a lower end attached to the inner lever arm;

drive means for tensioning the cable or chain, displacing the platform vertically, and rotating the lever in one rotational sense bringing the outer lever arm away from the teeth;

a stop on the outer lever arm engageable in the rack to arrest the platform on rotation of the lever in an opposite rotational sense; and a spring braced between the platform and the lever and urging the lever in the opposite sense, whereby when the cable or chain is detensioned the spring urges the stop into the rack and vertically arrests the platform.

2. The sheet-stacking apparatus defined in claim 1 wherein the spring is a compression spring braced against the inner arm.

3. The sheet-stacking apparatus defined in claim 2 wherein the lever has a central pivot and the cable or chain is attached to the inner arm between the pivot and the spring.

4. The sheet-stacking apparatus defined in claim 1 wherein the lever has a central pivot and the inner and outer arms extend at an obtuse angle to each other.

5. The sheet-stacking apparatus defined in claim 1 wherein the outer arm is provided with an elastomeric bumper carrying the stop.

6. The sheet-stacking apparatus defined in claim 1, further comprising a switch on the platform operable by the lever on rotation in the opposite sense.

* * * * *